US005360325A

United States Patent [19]

Henry, IV et al.

[11] Patent Number: 5,360,325

[45] Date of Patent: Nov. 1, 1994

[54] GEAR PUMP WITH REDUCED FLUID-BORNE NOISE

[75] Inventors: John W. Henry, IV, Annapolis; William F. Flickinger, Arnold; Joseph F. Dolinar, Jr., Severna Park; Francisco A. Rodriguez, Annapolis; James W. Smith, Sr., Glen Burnie; Rocco J. Gabriele, Jr., Baltimore, all of Md.

[73] Assignee: The United States of America as represented by the Secretary of the Navy, Washington, D.C.

[21] Appl. No.: 129,501

[22] Filed: Sep. 30, 1993

[51] Int. Cl.[5] ..... F04C 2/10

[52] U.S. Cl. ..... 418/126; 418/170

[58] Field of Search ..... 418/126, 170

[56] References Cited

U.S. PATENT DOCUMENTS 2,694,367 11/1954 Seavey ..... 418/170

FOREIGN PATENT DOCUMENTS 1191472 5/1970 United Kingdom ..... 418/170

*Primary Examiner*—John J. Vrablik

*Attorney, Agent, or Firm*—Charles D. Miller

[57] ABSTRACT

A crescent internal gear pump achieves greatly improved sealing against counter flow of fluid and greatly reduced noise by increase of the number of teeth of each of the ring and pinion gears which form discrete volumes of pumped fluid against a crescent-shaped member or insert. Reduction of the size of the teeth on the ring and pinion gears allows an increase in the angular extent of the crescent-shaped insert in order to increase the number of discrete volumes to be increased to a minimum of nineteen for each of the ring and pinion gears. The reduction in noise is accompanied by an increase in the fundamental frequency of the remaining noise, which can be more readily attenuated by acoustic filtering and isolation. Perfecting features of the invention include shaping of the crescent-shaped member to equalize the number of discrete volumes formed by each of the ring and pinion gears and shaping the teeth of the pinion gear to equalize the volumes of the discrete volumes formed by each gear.

2 Claims, 3 Drawing Sheets

GEAR PUMP WITH REDUCED FLUID-BORNE NOISE

DESCRIPTION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention generally relates to devices for pumping liquids and, more particularly, to positive displacement pumps having reduced fluid-borne noise.

2. Description of the Prior Art

Pumps have long been used in the handling of fluids of both liquid and gaseous phases and many designs have been developed for various applications. For purposes of conveying an appreciation of the present invention, pump designs may be considered to fall generally into two classes. One class of pumps is designed to move a large volume of fluids at a low pressure differential. Most such designs use an impeller, as in a centrifugal pump, or other rotary structure, such as in a fan, to provide a more-or-less continuous flow of fluid. Designs which provide for a continuous flow of fluid have been developed which reduce fluid-borne noise (e.g. principally in the form of small pressure variations in the inlet or outlet fluid flow) to very low levels. However, the pressure such pumps can develop is very limited and many designs cannot be adapted to avoid counterflow against a pressure at the pump outlet which is greater than the pressure which can be developed by the pump.

Pump designs which can produce high pressures of fluid at the outlet of the pump and resist counterflow are generically referred to as positive displacement pumps. The "positive displacement" of fluid by such pump designs in order to achieve high pressures inherently has the effect of quantizing the outlet flow into discrete pulses and the fluid-borne noise at the inlet and outlet of the pump is inherently high. This fluid-borne noise may also be propagated through the pump housing and other structures attached to the pump, particularly at the relatively low frequencies generally associated with positive displacement pumps. This noise is generally insusceptible of reduction without extensive acoustic filtering or isolation treatments which, to date, have been far less than fully effective for many applications. Currently, only about 20 dB of noise reduction can be obtained from acoustic filtering and only about 10 dB of noise reduction can be obtained from isolation for noise characteristic of currently available positive displacement pumps.

Fluid-borne noise is of some concern in virtually all pump applications since the energy required to produce acoustic noise is a component of energy loss and inefficiency. Also, since some pump designs may be extremely large and may be used in applications where personnel are present, noise can prove to be a concern for reasons of safety and health of those personnel. In some applications, however, noise is far more critical. In water-borne vessels, for example, fluid-borne acoustic noise, especially at low frequencies, is only slightly attenuated by water and may be propagated over extremely long distances. In other applications, such as in electro-hydraulic actuators, hydraulic motors, reverse osmosis charging pumps and submersible vessel (manned or unmanned) deballasting, desirable noise levels are more than 50 dB below levels generally produced (without acoustic treatment) by the quietest of positive displacement pumps now available.

Among the quietest current designs for positive displacement pumps currently known is the so-called crescent internal gear (CIG) pump. Gear pumps, in general, form a seal between the meshing teeth of at least two gears and, in other regions of the gears which are not meshed, a close clearance is provided between the tips of the gear teeth and a surface such as the interior of the pump housing, to allow discrete volumes of fluid in the interstices of the unmeshed gear teeth to be positively displaced. The volume of fluid which can be displaced is therefore a function of the volume of the interstices between the unmeshed teeth and the teeth of gear pumps are ordinarily designed to be as large as possible consistent with good meshing of gear teeth and limitation of mechanical noise attributable thereto.

The CIG type of gear pump includes a drive or pinion gear which meshes with the interior of an outer, annular, driven or ring gear. Both gears rotate within a housing but on different parallel axes which are spaced from each other. A substantial portion of the generally crescent-shaped space between the tips of the gear teeth at unmeshed locations is filled with a crescent-shaped insert to provide a close clearance at the tips of the gear teeth. The present state of the art now optimizes CIG pumps by placing 13 teeth on the drive gear and 17 teeth on the annular driven gear. The crescent-shaped insert, likewise, has been optimized to have an angular extent of about 135° with respect to the driven ring gear (and a lesser angle with respect to the pinion drive gear) in order to provide a close clearance with the tips of three or four teeth on the drive gear and five or six teeth on the driven gear and thus alternate the times of opening of the interstices between teeth into the outlet region of the pump.

While the fluid-borne noise from a CIG type of pump is among the lowest of all positive displacement pumps, efforts to further reduce fluid-borne noise such as angularly staggering the gear teeth in respective axial portions of the gears (which increases second harmonic noise), improving gear tooth profiles to deliver a more constant flow rate and determining end locations of the crescent insert such that the tips of gear teeth arrive at the ends of the insert alternatingly, have only achieved slight (e.g. a maximum of about 10 dB) improvement in noise reduction in comparison with the amount of noise reduction which is considered desirable.

Another characteristic of gear pumps in general and CIG pumps in particular is the inherent increase in noise with increases in the pressure differential across the pump. This problem has been particularly intractable for noise reduction efforts undertaken to date and is particularly critical for deballasting pumps in submersible vessels since the pump must produce a pressure greater than that exerted on the submersible vessel by the surrounding water which, of course, increases rapidly with the depth to which the vessel is submerged. Since both the noise level and the nature of the noise (e.g. harmonic content) may change with pressure, acoustic filtering and isolation of the inherent noise of the pump cannot be an effective solution to the problem of fluid-borne pump noise.

SUMMARY OF THE INVENTION

It is therefore an object of the present invention to provide a positive displacement pump having reduced inherent fluid-borne noise.

It is another object of the invention to provide a pump in which the inherent noise is more readily reduced by acoustic filtering and isolation and is attenuated rapidly by water.

It is a further object of the invention to provide a deballasting pump having extremely low levels of fluid-borne noise for submersible vessels.

In order to accomplish these and other objects of the invention, a crescent internal gear pump is provided including a pinion gear having teeth on an external circumference thereof, a ring gear having teeth on an internal surface thereof, meshing with the pinion gear and defining a crescent-shaped space between tips of teeth on the ring and pinion gears, and a crescent-shaped member positioned in the crescent shaped space and extending over an angle greater than 140° around a rotational axis of at least one of the ring gear and the pinion gear.

In accordance with another aspect of the invention, a crescent internal gear pump is provided including a pinion gear having teeth on an external circumference thereof, a ring gear having teeth on and internal surface thereof, meshing with teeth of the pinion gear and defining a crescent-shaped space between tips of teeth on the ring and pinion gears, and a crescent-shaped member positioned in the crescent-shaped space, wherein at least nineteen teeth on at least one of the ring gear and the pinion gear define discrete volumes with said crescent shaped member.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
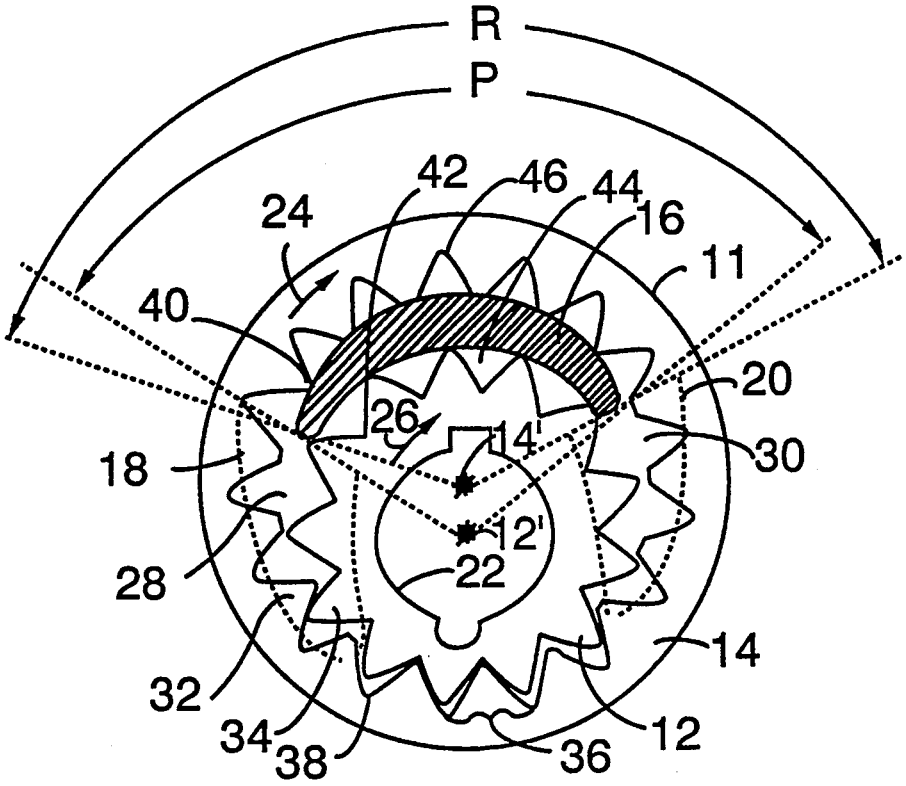
FIG.1 PRIOR ART
FIG. 1 is a sectional view of a conventional CIG pump.

Referring now to the drawings, and more particularly to FIG. 1, there is shown a sectional view of the gear arrangement of a commercially available CIG pump over which the present invention is an improvement. A housing will be fitted closely about the periphery 11 of ring gear 14 and provide a bearing therefor. The housing will also be closed at the ends of the gear arrangement at a very small clearance from the end faces of the gears to define inlet port 18 and outlet port 20 (corresponding to the rotation direction shown by arrows 24, 26) and to provide a support for accurately locating the crescent-shaped insert 16. Details of the housing are not otherwise important to the practice of the invention and are not otherwise shown. The pump structure is bilaterally symmetrical and the pump is therefore reversible by reversing the direction of rotation of the gears and can be used as a motor, as well.

The gear teeth 32, 34 of the conventional CIG pump are substantially triangular in profile to provide a tight seal in region 36 where the teeth of the pinion gear 12 and the ring gear 14 are fully meshed. However, a small, circular cross-section clearance 38 is formed between the teeth of the ring gear and flat surfaces 38, 40 (e.g. truncating the generally triangular cross-section) are provided at the tips of the teeth on both the pinion gear 12 and ring gear 14 to improve sealing against the crescent-shaped insert 16.

The pinion gear 12 is preferably carried on a shaft (not shown) at an aperture 22 through which power is applied to the pump. The shaft and pinion gear is thus rotated about axis 12'. The mesh of pinion gear 12 with ring gear 14 drives the ring gear to rotate about axis 14'. The bearing for ring gear 14 is not particularly important to the practice of the invention but a bearing provided by machining of the housing is generally preferred in order to support gear 14 without distortion, either from the fitting of the bearing or the pressures developed by the pump.

In operation, the increasing separation of the gears 12, 14 in the direction of rotation 26 away from meshed region 36 and the positive displacement of fluid against the insert 16 causes low pressure to be developed in the inlet region 28. Conversely, the decreasing separation of the gears in the direction of rotation toward meshed region 36 and the positive displacement of fluid causes a high pressure to be developed in outlet region 30. The fluid is carried in discrete volumes defined by the interstices 44, 46 between the gear teeth and the crescent-shaped insert 16. Assuming a good but imperfect seal between the gear teeth and the crescent-shaped insert at location 42, it can be readily understood how the pressure changes both within the discrete volumes 44, 46 and in the inlet and outlet chambers 28, 30 as the discrete volumes are opened and closed at the ends of the crescent-shaped insert cause noise at the fundamental frequency of the passage of gear teeth over the ends of the crescent-shaped insert. These pressure variations are propagated through the fluid as well as though all fluid carrying passages connected thereto as well as through the housing of the pump, itself, and all mechanical structures to which the pump may be connected.

Figure 2:
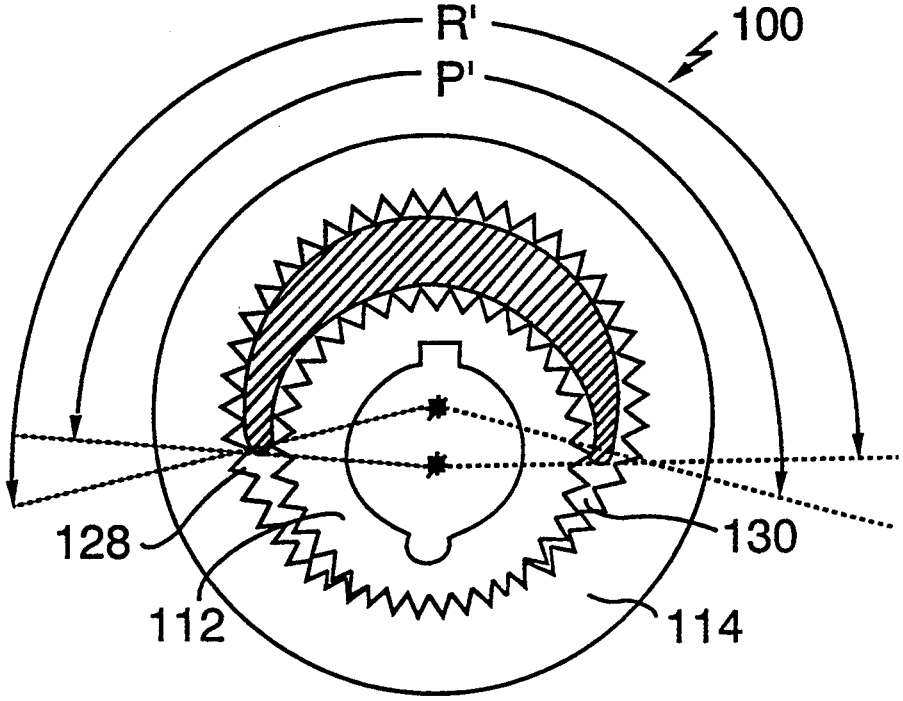
FIG. 2 is a sectional view of a CIG pump in accordance with the present invention.

A cross-sectional view of the CIG pump in accordance with the invention is shown in FIG. 2. The inventors have discovered that the cause of noise due to the opening and closing of the discrete volumes is quite complex and, in the CIG pump in accordance with the invention, numerous interrelated changes are made which, together, provide a positive displacement pump having greatly reduced fluid-borne noise.

Most evident from comparison of FIGS. 1 and 2 is the reduction of the size and increase in number (e.g. total or by unit angle about the gear axis) of the gear teeth relative to the conventional CIG pump. As shown, the number of the teeth has been increased by a factor of about three which reflects the change made in a test sample of the invention fabricated to demonstrate the efficacy of the invention and the underlying principles thereof. However, it is contemplated that increases in number of the gear teeth by a factor of up to ten compared to the conventional CIG pump will yield additional improvement in noise reduction in much the same manner.

It should also be noted from a comparison of FIGS. 1 and 2 that the angular extents P/P', R/R' of the crescent-shaped insert relative to the rotational axes of the pinion and ring gears, respectively, is substantially increased, as is made possible by the reduction of size of the gear teeth. (Note that the profiles of the ends of the crescent-shaped insert are approximately the same.) The combination of the increase in angular extent of the crescent-shaped insert beyond about 140° together with the reduced size of gear teeth allows an increased number of teeth of each of the ring and pinion gears to be adjacent to the crescent-shaped insert at all times and results in improved sealing against counter-flow of fluids as well as reduction in noise. Configurations of the pump such that a minimum of nineteen teeth of each of the ring and pinion gears is adjacent the crescent-shaped insert is considered to be within the scope of the invention.

The effects of the increase in the number of gear teeth are many and will be discussed in turn. Assuming a good but imperfect seal of the gear teeth against crescent-shaped insert 16, the pressure differential from outlet to inlet will be carried about equally by the surfaces of the gear teeth which are in contact with the crescent-shaped insert. Assuming a typical pressure differential of 1500 psi (corresponding to a water depth of about 3300 feet if the pump is to be used for deballasting a submersible vessel), the four teeth of the pinion gear 12 of the CIG pump of FIG. 1 would each carry a pressure differential of 375 psi and the pressure in each discrete volume would change by that amount (by leakage contrary to the pump flow) each time a tooth passes the end of crescent-shaped insert 16. A similar effect takes place on the ring gear where, for a 1500 psi pressure differential, each of the six teeth bearing against the crescent-shaped insert would carry 250 psi.

In the invention, by increasing the number of teeth (even if the angular extent of the crescent-shaped insert is not increased) the pressure differential carried by each tooth would be decreased by the same factor as the increase in the number of teeth. For example, increasing the number of teeth by a factor of ten would decrease the pressure differential carried by each tooth by a factor of ten. In addition, if the angular extent of the crescent-shaped insert is increased, the number of gear teeth bearing against or forming a close clearance with it is further increased and the pressure differential carried by each tooth would be further reduced. Thus, for a 1500 psi pressure differential across the pump of FIG. 2 in which, say, twenty teeth (for simplicity of calculation) of the pinion gear 112 are bearing against the crescent-shaped insert at the position of the pinion gear shown, the pressure differential carried by each tooth would be reduced to 75 psi. For the ring gear, in which 29 teeth bear on or are closely adjacent the insert, the pressure differential carried by each tooth is reduced below 52 psi. It should be also noted that for a liquid of a given compressibility, this reduction of pressure differential between discrete volumes is also reflected by reduced leakage. That is, the reduced pressure between discrete volumes reduces the ability of the pressure across the pump to cause leakage past the tips of the gear teeth.

The reduced volume of fluid carried in the interstices between the gear teeth also has the effect of increasing noise damping within the pump. Specifically, even though the volume of the inlet and outlet regions 128, 130 is somewhat decreased by the increased angular extent of the crescent-shaped insert, the ratio of the volume of fluid carried by each gear tooth to the volume of the inlet and outlet chambers is actually decreased. Therefore, there is a combined effect of reduced pressure and a reduction of the ratio of energy carried by a discrete volume of pumped fluid to the energy of the pressurized fluid in the outlet region (or low pressure fluid in the inlet region) and damping of fluid-borne noise in the inlet and outlet regions of the pump is increased due to the reduced relative magnitude of the pressure disturbance.

The reduced volume of fluid carried in the interstices between gear teeth also requires less leakage to distribute the pressure across the pump between the gear teeth bearing on the crescent-shaped insert. Therefore, the reduction in gear tooth size has the effects of reducing fluid-borne noise and improving pump efficiency. The effects of reduction in gear tooth size combines with the effects of the increased angular extent of the crescent-shaped insert to augment both of these effects.

The reduction of gear tooth size and increase of number also has the effect of increasing the fundamental frequency of fluid-borne noise by the same factor as the increase in the number of gear teeth. It is well-accepted that higher frequencies are generally less able to be mechanically propagated through the relatively massive pump housing and related structures and are less readily coupled to other mechanical structures. Higher frequencies are more readily controlled with acoustic filtering and isolation and are more quickly attenuated as they are propagated through water. Therefore, remaining fluid-borne noise in the pump having an increased number of gear teeth is more readily controlled through acoustic filtering and isolation and remaining fluid-borne noise is of reduced effect.

The inventors have recognized further complexities in the sources of fluid-borne noise in the CIG pump of FIG. 1 and the CIG pump in accordance with the invention preferably includes several perfecting features which will now be discussed. It will be recalled that relative positioning of the teeth and the ends of the crescent-shaped insert such that the interstices between teeth were opened and closed alternatingly between the pinion gear and the ring gear has been attempted in the past but with insufficient effect of noise reduction. Without wishing to be held to any particular theory of operation, it can certainly be appreciated from the above discussion that the differential pressures carried by each gear tooth are unequal between the pinion and ring gears and the alternating opening and closing of discrete volumes does not inherently cause balancing or good distribution of the disturbances caused thereby. Further, it can be appreciated that the discrete volumes carried by each tooth are unequal between the pinion and ring gears in a manner which may cause the effects thereof to be at least partially additive. That is, the higher pressure differential carried by each gear tooth and the discrete volumes defined by the interstices between teeth are both greater for the pinion gear than the ring gear because of the reduced number of teeth and the greater angular extent of each tooth and the interstices therebetween on the pinion gear.

Figure 3:
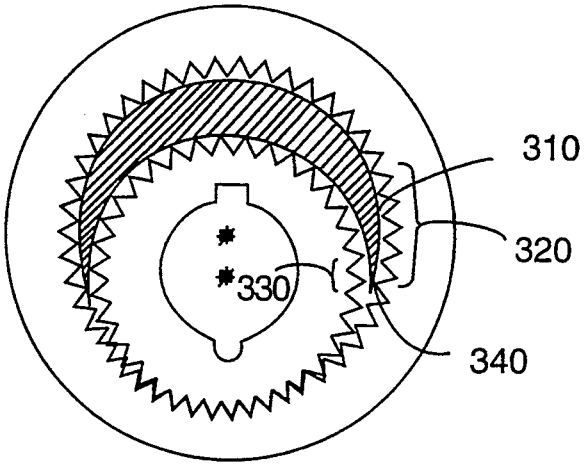
FIG. 3 is a sectional view of the GIG pump in accordance with the invention, including a perfecting feature of the crescent-shaped insert.

Referring now to FIG. 3, a first perfecting feature of the invention is shown. In this embodiment, the outer side of the crescent-shaped insert are shaped by tapering 310 so that the number of discrete volumes is the same for both the pinion gear and for the ring gear. This equalization of the number of discrete volumes causes equalization of the pressure differentials in discrete volumes formed by each of the pinion and ring gears. Additionally, while the effect has not been experimentally verified, the more gradual opening of the discrete volumes and the baffle-like effect of other gear teeth as the discrete volumes are opened and closed may increase damping effects on fluid-borne noise. For this reason, it may be advantageous to include tapering 330 of the concave side of the crescent-shaped insert in a similar manner along with increasing the angular extent of the tapered region on the convex side, possibly by providing a more sharply contoured end 340 of the crescent-shaped insert at either or both of the inlet and outlet sides of the pump. It may also be possible in very large pumps fabricated in accordance with the principles of the invention to adjust the tapered distances 320 and 330 relative to the speed of fluid flow and the propagation speed of pressure waves in the pumped fluid to achieve fairly exact cancellation of pressure disturbances at certain rotational speeds of the pump.

Of course, it should be recognized that the length of tapered portion 320 relative to the overall size of the pump can be reduced by increasing the size of the pinion gear relative to the size of the ring gear and making the crescent-shaped insert correspondingly thinner. While the design criteria are largely matters of mechanical robustness, a thickness of the crescent shaped insert comparable to that of FIG. 1 (but, of course, of increased angular extent) should allow the difference of diameters of the root circles of the pinion and ring gears to be decreased by about one-half, allowing a corresponding decrease in the difference of the number of teeth between these gears and, consequently, a decrease of about one-half in the extent of the taper necessary to achieve the equalization of the number of discrete volumes and the pressure within those volumes.

Figure 4:
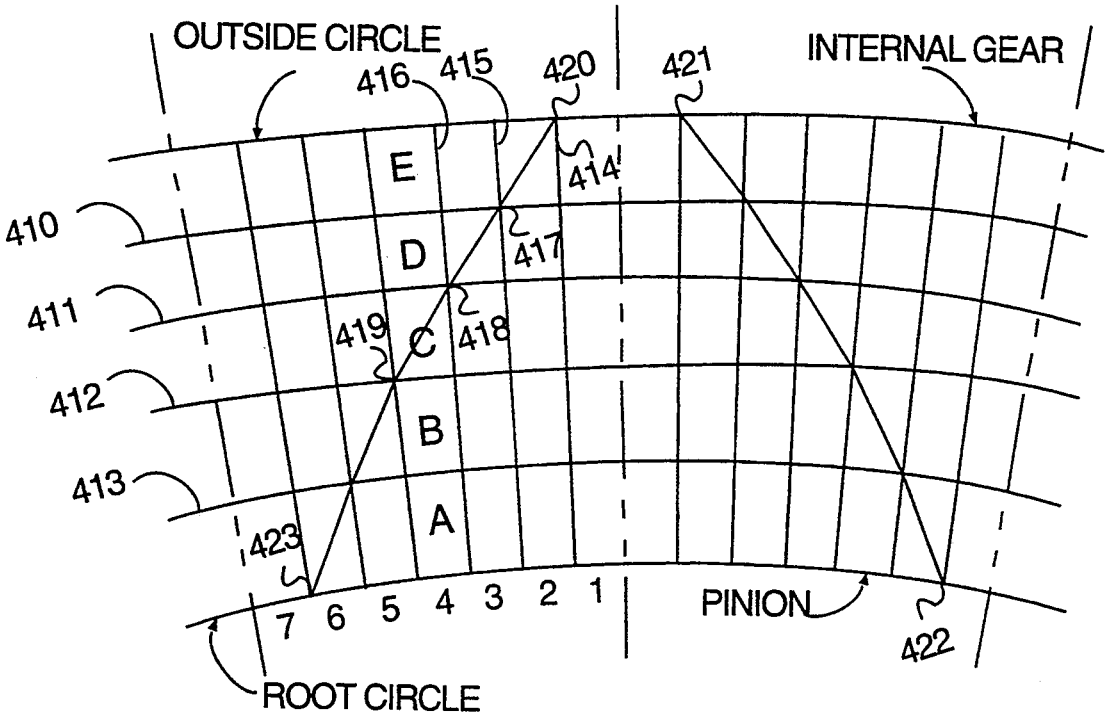
FIG. 4 is a graphical construction of a preferred gear tooth profile in accordance with the present invention.

Referring now to FIG. 4, a third perfecting feature of the invention will now be discussed. It was noted above that the volumes defined by the teeth of the pinion and ring gears differ when triangular profiles are employed. This difference is due to the different diameter and, hence, the different circumference of the root circles of the teeth of each of these gears even though more teeth are provided on the ring gear than on the pinion gear.

The volumes of the interstices between the teeth of these gears can be equalized by equalizing the volumes of the teeth themselves, preferably while retaining the triangular tooth profile of the ring gear. This is done by first determining the pitch radius of the pinion and ring gears and then determining the inner and outer diameters of the pinion gear in accordance with a 14½° full depth system, which is a common and well-understood technique of gear design. Once these inner and outer diameters or radii have been determined, the tooth profile for the inner pinion gear 112 can be determined graphically by constructing a plurality of equal area annuli between circles respectively having these radii as by drawing circular segments 410, 411, 412, and 413. The resulting annuli between these lines are further divided into a grid by equiangularly spaced lines, for instance 414, 415, 416, and the tooth profiles determined by curves connecting the intersections, for instance 417, 418 and 419, of the angularly and radially spaced divisions of the area (e.g. by mapping the generally triangular tooth profiles as determined by the lines connecting points 420, 421, 422 and 423 of the ring gear onto a grid formed by the equiangularly spaced lines and the boundaries of contiguous annuli of equal area). In this manner, the tooth volumes of the pinion and ring gears can be equalized while maintaining a meshing geometry adequate for production of a good seal.

It can then be appreciated that each of these perfecting features of the invention can be separately expected to reduce the fluid-borne noise of the CIG pump in accordance with the invention. However, when these perfecting features are used in combination, significant cancellation of noise sources can be achieved with greater reduction of noise than is attributable to the sum of the individual noise reductions. However, the realization of each of these individual effects is enhanced by the combination of these features with a CIG pump having reduced tooth size and increased angular extent of the crescent-shaped insert in accordance with the embodiment of the invention shown in FIG. 2.

Figure 5:
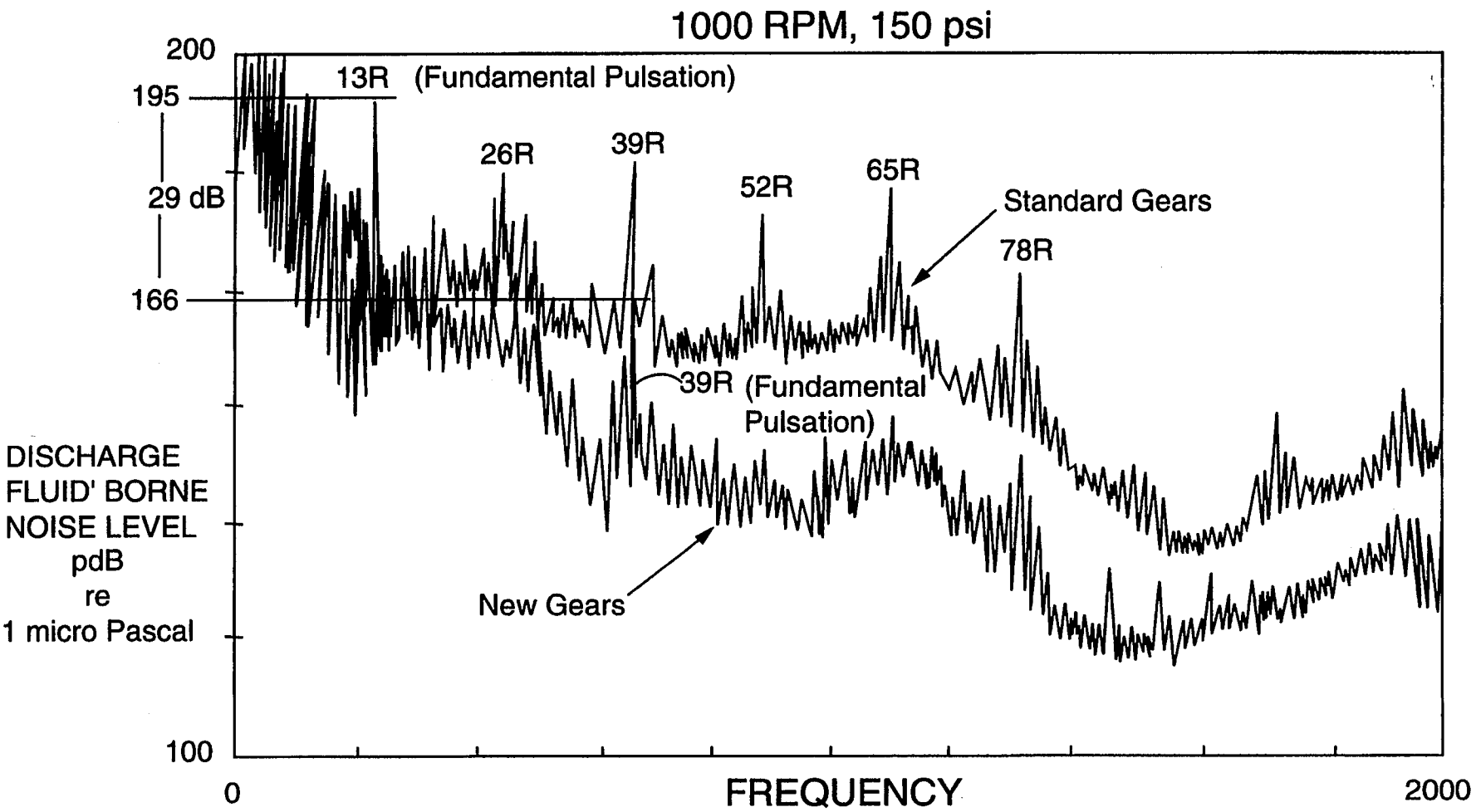
FIG. 5 is a graphical comparison of water borne noise of a conventional CIG pump and a CIG pump in accordance with the present invention.

The efficacy of the reduction of inherent noise of the CIG pump can be appreciated from the preliminary results, shown in FIG. 5, measured from the test model mentioned above. In this test, pumps corresponding to FIGS. 1 and 2 were operated at the same rotational speed into a pressure of 150 Psi. The resulting measured spectra of the two pumps showed that the fluid-borne noise at the fundamental pulsation frequency was reduced by 29 dB for the CIG pump of FIG. 2 in accordance with the invention. A 29 dB noise reduction is equivalent to a factor of 28 improvement (e.g. in the ratio of signal to background noise for detection) over the conventional CIG pump. Further, the conventional pump showed high level tones for at least five multiples of the 13R (corresponding to the 13 teeth of the pinion gear) tone. The pump fabricated in accordance with the invention shows only one multiple at a lower level.

It should be understood that the pump fabricated in accordance with the invention has a reduced displacement per unit of axial length and thus a reduced pumping capacity. However, low flow rates are desirable for deballasting applications in which the movement of the fluid itself can be a source of noise when detection is of concern. However, the reduced flow rate can be avoided or partially compensated to any desired degree simply by increasing the axial length of the pump, increasing the pump drive rotational speed (which advantageously would also raise the fundamental frequency of remaining fluid-borne noise) or by increasing the pump diameter which would further increase the number of gear teeth, enhancing the effects of the invention while facilitating the implementation of the various perfecting features of the invention discussed above. For example, as the diameter of the pump is increased, for a given thickness of crescent-shaped insert, the diameter of the gears and the tooth numbers can be made more nearly equal and tooth volumes can be made to more closely approach the volumes of the interstices between them as well as more nearly uniform between the ring and pinion gears.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A crescent internal gear pump including a pinion gear having teeth on an external circumference thereof, a ring gear having teeth on an internal surface thereof, said ring gear and said pinion gear being positioned to mesh at a location and to define a crescent-shaped space between tips of said teeth on said ring and pinion gears opposite said location where said ring gear and said pinion gear are meshed, and a crescent-shaped member positioned in said crescent-shaped space and extending over an angle greater than 140° around a rotational axis of at least one of said ring gear and said pinion gear, said crescent-shaped member and said teeth of said ring and pinion gears defining discrete volumes;

and wherein at least one said crescent-shaped member is out of contact with said ring gear near the end of said member so that said discrete volumes formed by said crescent-shaped member and said teeth of said pinion gear are approximately equal in number to the discrete volumes formed by said crescent-shaped member and said teeth of said ring gear.

2. A crescent internal gear pump including a pinion gear having teeth on an external circumference thereof, a ring gear having teeth on an internal surface thereof, said ring gear and said pinion gear being positioned to mesh at a location and to define a crescent-shaped space between tips of said teeth on said ring and pinion gears opposite said location where said ring gear and said pinion gear are meshed, and a crescent-shaped member positioned in said crescent-shaped space, wherein at least nineteen of said teeth on at least one of said ring gear and said pinion gear define discrete volumes with said crescent shaped member;

and wherein said crescent-shaped member is out of contact with said ring gear near at last one end of said member so that said discrete volumes formed by said crescent-shaped member and said teeth of said pinion gear are approximately equal in number to the discrete volumes formed by said crescent-shaped member and said teeth of said ring gear.

* * * * *